United States Patent [19]

Grasberger et al.

[11] Patent Number: 4,604,758

[45] Date of Patent: Aug. 12, 1986

[54] SAFETY BIB FOR ENGAGING A PACIFIER

[76] Inventors: Christine L. Grasberger, 5 Care Free La.; Eileen M. Martin, 6 Care Free La., both of Gansevoort, N.Y. 12831

[21] Appl. No.: 810,516

[22] Filed: Dec. 18, 1985

[51] Int. Cl.[4] ..... A41B 13/10

[52] U.S. Cl. ..... 2/49 R

[58] Field of Search ..... 2/49 R, 49 A, 48, 51; 224/148

[56] References Cited

U.S. PATENT DOCUMENTS 298,985 5/1884 Kimball ..... 2/49 R 4,564,957 1/1986 Scharf ..... 2/49 R

*Primary Examiner*—Doris L. Troutman

*Attorney, Agent, or Firm*—Frank R. Agovino

[57] ABSTRACT

The invention comprises an article for engaging the ring of a pacifier and for holding the pacifier about the neck of an infant. A first flat panel or collar has a substantially rectangular shape and has a notch for engaging the infant's neck. The notch forms an arcuate portion in the first panel. The arcuate portion conforms to the infant's neck and forms right and left tabs for engaging the infant's neck. Interlocking means are attached to at least one of the tabs for engaging the other tab thereby permitting the notch to be closed about the infant's neck. A second flat panel is provided having upper and lower ends. The upper end has an arcuate edge and engages the arcuate portion of the first flat panel. The lower end of the second flat panel has a means for engaging the pacifier ring. The engagement between the arcuate edge and the arcuate portion causes the underside of the second flat panel to be positioned adjacent to the overside of the first flat panel.

15 Claims, 7 Drawing Figures

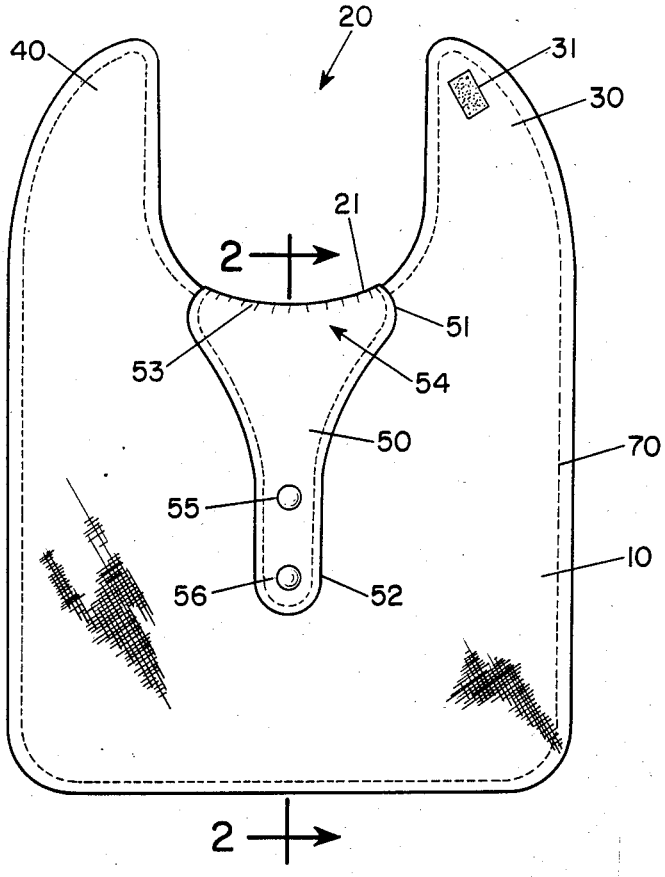
FIG. 1
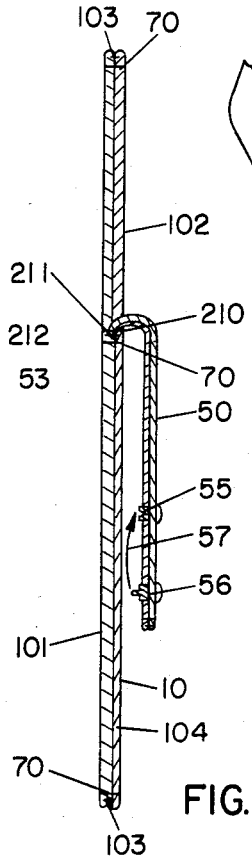
FIG. 2
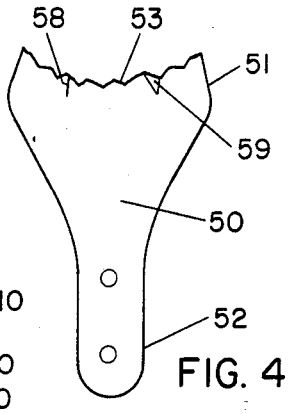
FIG. 4
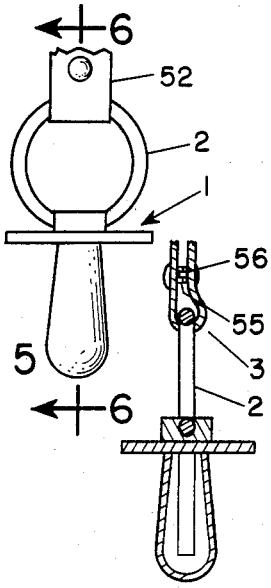
FIG. 5
FIG. 6
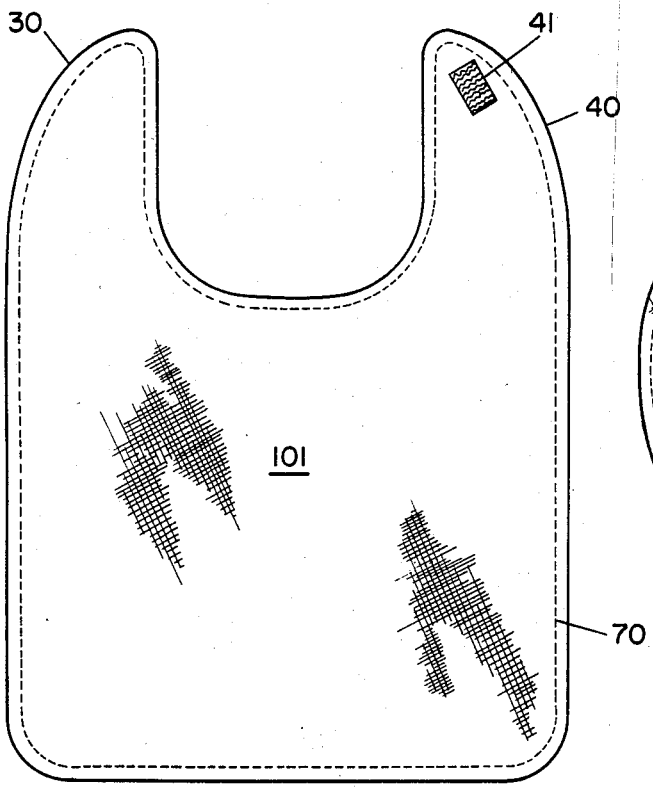
FIG. 3
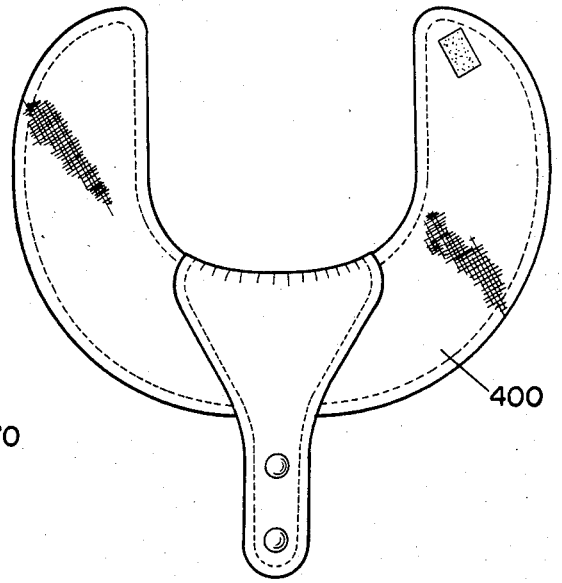
FIG. 7

SAFETY BIB FOR ENGAGING A PACIFIER

BACKGROUND OF THE INVENTION

1. Field of the Invention

The invention generally relates to bibs and, in particular, a bib including a structure for engaging a pacifier ring.

2. Description of the Prior Art

The combination of a bib and a pacifier was originally disclosed in U.S. Design Pat. No. 242,503 to Derifield. Therein, Derifield shows a bib having a ribbon attached to it. The ribbon has a loop at the end for engaging the ring of a pacifier.

Bibs have also been used to engage other items such as nursing bottles. For example, U.S. Pat. No. 4,473,907 issued to Susan Maillard describes a combined insulated enclosure and bib for support of a nursing bottle. In this regard, also see U.S. Pat. No. 298,985 to Kimball and U.S. Design Pat. No. 232,058 for a bottle holding infant jacket by Palomares.

The above prior art as well as all prior art suffers from significant deficiencies with regard to the combination of a bib and the pacifier. First of all, it is important that the pacifier be held immediately in front of the infant wearing the bib/pacifier combination so that the pacifier is always located in the same place and is easily visible and accessible.

In this regard, it has been found that the invention promotes hand and eye coordination of the infant at a very early age because the infant can always find the pacifier in the same place and is able to grab it and place it in its mouth. Second of all, it is necessary that the pacifier supporting means have substantial structure so that it cannot wrap around the infant's neck or otherwise get tangled in the fingers of the infant. In this regard, the Derifield patent is seriously deficient. Third of all, the pacifier engaging portion of the bib must easily engage the pacifier yet maintain the pacifier in a fixed position so that the infant cannot separate the pacifier from the engaging portion.

Clearly, the purpose of combining the pacifier and bib is to prevent the pacifier from dropping and causing anxiety in the infant. In addition, the support of the pacifier on the bib keeps the pacifier fairly clean. In addition, the support of the pacifier on the bib allows nurseries and other day care centers to associate particular pacifiers with infants and prevent the pacifiers from becoming mixed up or shared.

SUMMARY OF THE INVENTION

It is an object of this invention to describe a bib including a means for engaging a pacifier which maintains the pacifier in the same position centrally located over the bib.

It is another object of this invention to describe a bib having a pacifier engaging portion which firmly and easily can be affixed to the ring on the pacifier.

It is another object of this invention to describe a pacifier ring engaging structure which cannot easily be separated from the pacifier ring by an infant wearing it.

BRIEF DESCRIPTION OF THE DRAWINGS

These features of the invention as well as others will become apparent to those skilled in the art by referring to the drawing and the accompanying description thereof in which:

FIG. 1 is a plan view of the safety bib for engaging a pacifier according to the invention.

FIG. 2 is a longitudinal sectional view of the bib shown in FIG. 1 taken along lines 2—2.

FIG. 3 is a bottom plan view of the safety bib according to the invention.

FIG. 4 is a plan view of the second flat panel which engages the pacifier ring according to the invention.

FIG. 5 is a partial view showing the end of the second flat panel engaging a pacifier ring.

FIG. 6 is a sectional view taken along lines 6—6 of FIG. 5.

FIG. 7 is an alternative embodiment of the invention showing a collar including a flat panel for engaging a pacifier.

DETAILED DESCRIPTION OF THE INVENTION

Referring to FIG. 1, the article according to the invention is shown in a top plan view. The purpose of the article is for engaging a pacifier ring and for holding the pacifier about the neck of an infant. The article engages the ring and holds it in place in front of the infant. Specifically, the article includes a first flat panel 10. This flat panel 10 has a substantially rectangular shape and is provided with a notch 20 for engaging an infant's neck. The notch is formed by an arcuate or curved portion 21 in the first panel 10. The arcuate portion 21 is curved to conform to the infant's neckline. The notch forms a right tab 30 and a left tab 40 which also engage the infant's neck. Tab 30 is provided with an interlocking means 31 for engaging the left tab 40 so that the tabs may be closed about the infant's neck thereby closing the notch 20. The details of this interlocking means will be discussed in more detail below.

An important feature of the invention is the second flat panel 50 having an upper end 51 and a lower end 52. The upper end is provided with an arcuate edge 53 and engages the arcuate portion 21 of the first flat panel 10. As shown in FIG. 1, the arcuate edge 53 may be topstitched by stitches 54 to the arcuate portion 21 of the first flat panel 10.

The lower end 52 of the second flat panel 50 includes a means for engaging the pacifier ring in the form of snaps 55 and 56 which will be described in more detail below.

Another key feature of the invention is the engagement between the arcuate edge 53 and the arcuate portion 21. This engagement causes the underside of the second flat panel 50 to be positioned adjacent and up against the overside of the first flat panel 10. This engagement also causes lateral rigidity between the first panel 10 and the second panel 50 so that the pacifier is always located in the center of the first panel 10. This aspect of the invention is shown in more detail in the sectional view of FIG. 2.

Preferrably, flat panel 10 is comprised of two pieces of cloth or other material which are sewn together. As illustrated in FIG. 2, flat panel 10 may be made of an underside of material 101 and an overside of material 102. The edges of the material are held together at point 103 by edge stitching which is done on the wrong side of the fabric. Flat panel 10 is then turned right-side-out. In order to provide some substance and rigidity to flat panel 10, a binder or filler 104 may be included between the overside 102 and the underside 101.

FIG. 2 is an expanded sectional view so that all these different features of the invention can be clearly illustrated. During assembly, the arcuate edge 53 of the second flat planel 50 is inserted between the arcuate edge 210 of the overside 102 and the arcuate edge 211 of the underside 101. This structure is then sewn together by stitching 212 which is an edge stitch done on the wrong side of the flat panel 10. For additional reinforcement, flat panel 10 may be provided with border stitching 70 as illustrated in FIGS. 1 and 2.

The underside of the flat panel 10 is illustrated in a plan view in FIG. 3. Underside 101 is provided with interlocking means 41 for engaging interlocking means 31 of tab 30. These interlocking means may be any well known structure such as snaps, clasps or velcro which may engage each other so that the tabs 30, 40 may be placed around the infant's neck and firmly held in place. For example, it is contemplated that interlocking means 31 may be a piece of hook fastening material such as a velcro hook fastener and that interlocking means 41 may be its complementary loop material.

The specific structure of the second flat panel 50 is shown in sectional view in FIG. 2 and in a plan view in FIG. 4. The upper end 51 is provided with an arcuate portion 53 which is illustrated as being cut by pinking shears for convenience to prevent unraveling. This is the arcuate portion 53 that is inserted between the arcuate portions 210, 211 of the overside 102 and the underside 101, respectively, of the flat panel 10. This arcuate engagement is significant. It forces the second flat panel 10 to be held in place immediately in front of the infant so that the lower end 52 is always located in the approximate center of the first flat panel 10. If necessary, slits 58 or V-cuts 59 may be included in the upper edge. This is an important structural part of the invention because the tab 50 is prevented from twisting or otherwise moving from side to side. Because the location of the tab with respect to the bib rectangular portion 10 is always the same, an infant wearing the bib will always know where to find the pacifier.

Another feature of the invention is the particular way in which tab 50 engages the pacifier ring. As shown in FIG. 2, the underside of flat panel 50 is provided with a snap 56 having a projection and a seat 55 for receiving and engaging the projection. Of course, any well known interlocking structure may be used in this regard as long as the lower end 52 of flat panel 50 can be folded under and engage the center, underside of flat panel 50. This folding under of the end of the flat panel is indicated by arrow 57 and provides special features to the invention. Specifically, the underfolded engagement of the pacifier ring prevents the infant from accidentally or purposefully unsnapping or disengaging snaps 55 and 56 and the pacifier ring from the lower end 52 of the flat panel 50. This aspect of the invention works in combination with the lateral rigidity of the flat panel 50. Specifically, since the flat panel 50 is always located in the same place with respect to flat panel 10 and does not easily become twisted or move right or left of its location, it is unlikely that the infant wearing the invention can accidentally or purposefully find the end 52 of the flat panel 50 and grab it and thereby disengage the pacifier from the invention.

FIGS. 5 and 6 show the engaging of the pacifier ring and tab 50.

Specifically, pacifier 1 having a ring 2 is engaged by lower end 52 of the flat panel 50. In actual use, the end 52 is inserted through the ring 50 and folded under, around the ring and then snap 56 is pushed into seat 55 to engage and form a loop, generally indicated by reference character 3.

FIG. 7 shows an alternative embodiment of the invention where the rectangular flat planel 10 is replaced by collar 400. This embodiment functions in the same way and is assembled in the same way as the embodiment illustrated in FIGS. 1–6. In the embodiment in FIG. 7, the basic distinction between the two embodiments is that the base or supporting panel, which in the FIG. 1 embodiment is panel 10, is smaller and does not provide the benefit of a bib.

These features and objects of the invention as well as others will become apparent to those skilled in the art by referring to the above specification and the drawings. However, the above description is not intended as a limitation but merely as exemplary of the basic features and aspects of the invention. The following appended claims will define the scope of the invention.

What is claimed is:

1. An article for enaging the ring of a pacifier and for holding the pacifier about the neck of an infant, said article comprising:

a first flat panel having a substantially rectangular shape and having a notch for engaging the infant's neck;

the notch being defined by an arcuate portion in the first panel, said arcuate portion conforming to the infant's neckline and forming right and left tabs for location around the infant's neck;

interlocking means attached to at least one of the tabs for engaging the other tab thereby closing the notch about the infant's neck;

a second flat panel having upper and lower ends;

the upper end of the second panel having an arcuate edge engaging the arcuate portion of the first panel;

the lower end of the flat panel having means for engaging the pacifier ring; and the engagement between the arcuate edge and the arcuate portion causing the underside of the flat panel to be positioned adjacent to the overside of the first flat panel.

2. The article of claim 1 wherein said means for engaging the pacifier ring comprises first locking means attached to the underside of the lower end of the second flat panel and second locking means attached to the underside of the second flat panel between the first locking means and the upper end of the flat panel, said first locking means for engaging said second locking means such that the lower end of the second flat panel may be folded under to form a loop within which the pacifier ring may be held.

3. The article of claim 2 wherein the first locking means is a snap having a projection and the second locking means is a snap having a seat for receiving the projection.

4. The article of claim 3 wherein the upper end of the second flat panel has a width which is at least one half the width of the notch, said flat panel having substantial lateral rigidity thereby maintaining its position directly in front of the notch and approximately in the center of the first flat panel.

5. The article of claim 4 wherein said first flat panel is formed of two halves of material, a lower half and an upper half which are sewn together about their periphery, the second flat panel having its upper end being located between the halves of the arcuate portion and sewn along its periphery.

6. The article of claim 5 wherein the interlocking means comprises a third locking means attached to the left tab and a fourth locking means attached to the right tab, said third locking means for engaging said fourth locking means.

7. The article of claim 6 wherein the third locking means is a hook fastener and the fourth locking means is a loop fastener.

8. An article for engaging the ring of a pacifier and for holding the pacifier about the neck of an infant, said article comprising:

a flat collar having a notch for engaging the infant's neck;

the notch being defined by an arcuate portion in the first panel, said arcuate portion conforming to the infant's neckline and forming right and left tabs for location around the infant's neck;

interlocking means attached to at least one of the tabs for engaging the other tab thereby closing the notch about the infant's neck;

a flat panel having upper and lower ends;

the upper end of the flat panel having an arcuate edge engaging the arcuate portion of the flat collar;

the lower end of the flat panel having means for engaging the pacifier ring; and the engagement between the arcuate edge and the arcuate portion causing the underside of the flat panel to be positioned adjacent to the overside of the flat collar.

9. The article of claim 8 wherein said means for engaging the pacifier ring comprises first locking means attached to the underside of the lower end of the flat panel and second locking means attached to the underside of the flat panel between the first locking means and the upper end of the flat panel, said first locking means for engaging said second locking means such that the lower end of the flat panel may be folded under to form a loop within which the pacifier ring may be held.

10. The article of claim 9 wherein the first locking means is a snap having a projection and the second locking means is a snap having a seat for receiving the projection.

11. The article of claim 10 wherein the upper end of the flat panel has a width which is at least one half the width of the notch, said flat panel having substantial lateral rigidity thereby maintaining its position directly in front of the notch.

12. The article of claim 11 wherein said flat collar is formed of two halves of material, a lower half and an upper half which are sewn together about their periphery, the flat panel having its upper end being located between the halves of the arcuate portion and sewn along its periphery.

13. The article of claim 12 wherein the interlocking means comprises a third locking means attached to the left tab and a fourth locking means attached to the right tab, said third locking means for engaging said fourth locking means.

14. The article of claim 13 wherein the third locking means is a hook fastener and the fourth locking means is a loop fastener.

15. A method of making an article for engaging the ring of a pacifier and for holding the pacifier about the neck of an infant, said method comprising the steps of:

cutting material to form a first flat panel having a notch for engaging the infant's neck;

cutting the notch to form an arcuate portion in the first flat panel, said arcuate portion conforming to the infant's neckline and forming right and left tabs for location around the infant's neck;

attaching interlocking means to at least one of the tabs for engaging the other tab thereby permitting closure of the notch about the infant's neck;

cutting material to form a second flat panel having upper and lower ends;

cutting the upper end to have an arcuate edge;

sewing the arcuate portion of the first flat panel to the arcuate edge of the second flat panel;

attaching means for engaging the pacifier ring to the lower end of the second flat panel.

* * * * *